United States Patent [19]

Yamasaki

[11] Patent Number: 4,795,942

[45] Date of Patent: Jan. 3, 1989

[54] HOLLOW CATHODE DISCHARGE DEVICE WITH FRONT SHIELD

[75] Inventor: George K. Yamasaki, Horseheads, N.Y.

[73] Assignee: Westinghouse Electric Corp., Pittsburgh, Pa.

[21] Appl. No.: 43,575

[22] Filed: Apr. 27, 1987

[51] Int. Cl.[4] ..... H01J 17/06

[52] U.S. Cl. ..... 313/618; 313/615

[58] Field of Search ..... 313/618, 613, 615, 616, 313/339, 356, 352

[56] References Cited

U.S. PATENT DOCUMENTS

| | | | |
|---|---|---|---|
| 3,264,511 | 8/1966 | Yamasaki | 313/615 |
| 4,339,691 | 7/1982 | Morimiya et al. | 313/618 X |
| 4,698,550 | 10/1987 | Kobayashi et al. | 313/618 |

*Primary Examiner*—David K. Moore
*Assistant Examiner*—K. Wieder
*Attorney, Agent, or Firm*—G. H. Telfer

[57] ABSTRACT

A hollow cathode discharge device loosely supported by a cathode lead-in 26 in a glass sleeve 32, the device including a ceramic shield 42 received in the rim 38 of the glass sleeve in freely slidable relation thereto, and maintained in position by holding means such as a mica disc 48 supported from the anode structure including an anode lead-in 30.

7 Claims, 2 Drawing Sheets

HOLLOW CATHODE DISCHARGE DEVICE WITH FRONT SHIELD

BACKGROUND OF THE INVENTION

This invention relates generally to a discharge device providing a spectral light source, and more particularly to a hollow-cathode type light source.

Hollow-cathode light sources are used in atomic absorption spectroscopy. Such light sources provide high intensity, sharply defined spectral lines for many analytical applications. One conventional hollow-cathode type light source design is shown in U.S. Pat. No. 3,264,511. In these devices the spectral light is produced as a result of a concentrated discharge which takes place between an anode and a hollowed or bore portion of a cathode. The bore part of the cathode contains the atomic species which generates the desired spectral light output. The discharge should be confined to the bore part of the cathode to achieve most efficient and stable operation.

The noted patent and the following listed U.S. patents owned by the assignee of this invention show various arrangements that include means to prevent high voltage arcing and to promote light output and stability: U.S. Pat. Nos. 4,071,802; 3,855,491; 3,725,716; and 3,563,655. These patents all include mica discs extending transversely within the outer glass envelope of the device including at least one disc between the anode ring and the cathode, as well as insulating sleeves on the anode lead-ends.

Additionally, known commercial forms of hollow-cathode devices have an interior glass sleeve structure which loosely encases the cylindrical cathode circumferentially and necks down and tightly encases the cathode lead-in, to the end of reducing spurious discharges between anode structure and cathode.

Nevertheless, even with the internal glass sleeve arrangement, intermittent spurious discharges occur between the sides and base of the cathode and the inside face of the glass sleeve presented thereto. The front face of the cathode around the hollow or bore is also exposed to unwanted discharges. Because the desired spectral light output is primarily derived from inside the hollow or bore, the spurious discharges within the glass sleeve will cause variations in light output, and the front face discharges can, in themselves, reduce maximum attainable light output by as much as 50%.

Accordingly, it is the aim of the invention to reduce light output noise and fluctuations by shielding all external cathode surfaces where unwanted discharges can occur, and to thereby concentrate all available discharge current to the inside of the bore so that light output is increased.

SUMMARY OF THE INVENTION

In its broader aspects, the invention contemplates the provision of a hollow-cathode discharge device of the general type described and having an interior glass sleeve with an open-ended diametrically larger part loosely encasing the cylindrical cathode, and a neck-down diametrically smaller part tightly encasing the cathode lead-in so that the cathode is supported in the larger part, the rim of the larger part projecting beyond the face of the bore end of the cathode, and a ceramic shield in the general form of the circular disc having at least one part thereof having an outer diameter slightly less than the inside diameter of the larger part of the sleeve, with the one part of the shield being received in the projecting rim part of the sleeve, the shield having a central opening generally aligned with the bore of the cathode, and holding means fixed to the anode structure of the device and contacting the shield to hold the shield in its position in the sleeve.

Other aspects of the invention deal with particular shapes and surface shapes of the shield and will be described in some detail hereinafter.

DESCRIPTION OF PREFERRED EMBODIMENTS

Figure 1:
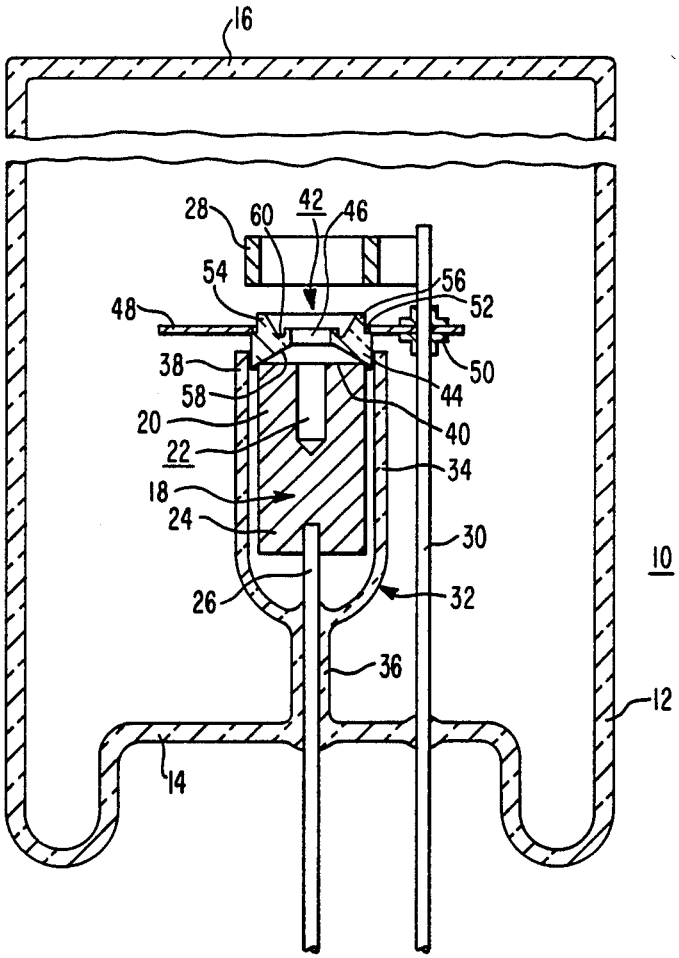
FIG. 1 is a broken vertical cross-section of a hollow cathode device provided with one form of ceramic shield and holding means according to the invention.
Figure 2:
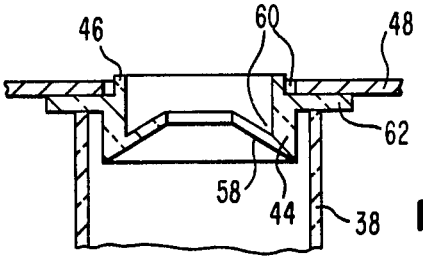
FIGS. 2–5 are fragmentary views in vertical cross-section illustrating other forms of ceramic shields in accordance with the invention.
Figure 3:
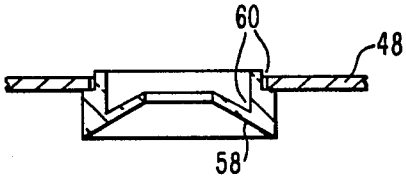
Figure 4:
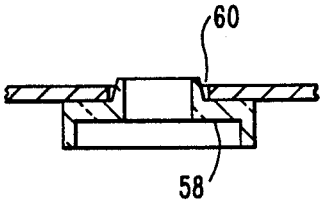

Referring to FIG. 1, the hollow-cathode device generally designated 10 has a generally cylindrical, hermetically sealed light transmissive outer envelope 12. A selected fill gas, such as neon or argon, is provided within the space defined by the envelope at a pressure of several torr. The envelope 12 is a vitreous material such as glass, and has a base 14 at one end and a highly transmissive window 16 (typically borosilicate or quartz) at the other end.

A hollow-cathode generally designated 18 has a hollow-end portion 20 with a bore 22 facing the transmissive window 16 and a solid end part 24. A cathode electrical lead-in 26 supports the cathode 18 and provides the electrical connection for the cathode to the exterior of envelope 12. The anode structure for the device includes a ring anode 28 and a single anode lead-in 30 which supports the ring anode and also provides the electrical connection to the exterior of the envelope 12. While a single anode lead-in is shown for purposes of example, many devices include two anode lead-ins as is shown in most of the patents noted hereabove. All of the structure described so far is conventional and well understood in its arrangement and in its operation by those skilled in the art.

A generally goblet-shaped interior glass sleeve generally designated 32 includes an open-ended diametrically larger cup-shaped part 34 which loosely encases the cylindrical cathode 18, and a necked-down diametrically smaller stem part 36 which tightly encases the cathode lead-in 26 so that the cathode 18 is supported in the cup part of the sleeve. The cup part of the sleeve has an axial dimension such that the rim 38 of the cup projects beyond the hollowed-end face 40 of the cathode. The cathode 18 is loosely received within the sleeve 34 so that there is no interference between the elements with heating and cooling in the tube so that differences in thermal expansion rates of the elements can be accommodated.

A ceramic shield generally designated 42 in the general form of a circular disc has at least one part 44 having an outer diameter slightly less than the inside diameter of the cup part 34 of the sleeve. This one part 44 of the shield is received in the projecting rim part 38 of the sleeve. This one part 44 of the shield has a diameter relative to the rim 38 which permits the shield to freely slide inside the sleeve to permit easy alignment with the particular cathode used, which can vary in height from tube to tube. With the shield having the shape shown in FIG. 1, the shield will seat upon the hollow end face 40 of the cathode. The shield 42 also has a central opening 46 which, in its installed position in the sleeve, is generally aligned with the bore 22 of the cathode.

Since the shield 42 is freely slidable in the glass sleeve, means fixed to the anode structure is provided to contact the shield to hold the shield in its position in the sleeve. Such holding means can take various forms and one form is shown in FIG. 1 in which a relatively thin, flat, circular, mica disc 48 is fixed to the anode lead-in 30 through a pair of eyelets 50 spot welded to the anode lead-in. The mica disc 48 is circular in shape and is provided with a central opening 52 which cooperates with a part 54 of the shield 42 which projects beyond the rim 38 of the glass sleeve and is provided with a shoulder 56 received in the central opening 52. With this arrangement the slightly flexible mica permits the shield to slide axially in the sleeve to compensate for any thermal expansion which may occur during cathode processing and operation.

In the operation of these discharge devices, the sputtering which occurs can lead to a build-up of materials on the insulating surfaces of the shield and disc. This can ultimately lead to a shortened life of the tube, particularly if the build-up proceeds to the point of near continuity of a path between cathode and anode. After long operation, the mica disc will become coated with the sputtered material. The shield can also receive sputtered material; therefore, the shield is accordingly provided with shaped surfaces to reduce the possibility of bridging paths and spurious discharges. To this end, the part 44 of the shield received within the glass sleeve has a surface 58 facing the hollowed end of the cathode that is, in at least the vicinity of the central opening 46, spaced substantially farther from the plane of the hollowed-end face 40 of the cathode than the surface part of the shield at its periphery. This means that the part of the shield adjacent the central opening 46 will not be at cathode potential until there has been sufficient build-up on the shield to reach the central opening. This contrasts with the central opening area being at the cathode potential if a flat bottom surface were provided on the shield. It will be seen from FIGS. 2–5 that the same principle is applied to the bottom surface shaping of each of the other forms of the shield.

It is also known that sputtered material will more likely coat a surface that is in a straight line direction from the point of emission of the sputtered material. To the end again of preventing, or at least delaying, the build-up of material to provide a near continuous path, the upper surface of the shield facing the anode ring 28 is formed with a shape between the central opening 46 of the shield and the outer periphery of the shield to include portions at abrupt angles to each other to promote the presence of a gap in deposits of material on the shield which would tend to bridge toward the anode structure. The location of the angle structure promoting the gap is indicated by the numeral 60 in all of the figures of the drawing.

The alternate shapes for the ceramic shield shown in FIGS. 2-5 should be fairly self-evident. However, it is noted that in FIG. 2 the shield shape includes a part 62 in the form of a circumferential flange which is adapted to rest on the rim 38 of the glass sleeve.

Figure 5:
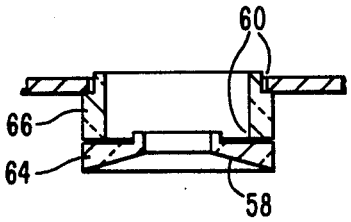

The shield in FIG. 5 differs from the other shields in that it comprises two separate pieces, a lower piece 64 and an upper piece 66 which may be desirable in respect of manufacturing simplicity.

Tubes using the general design disclosed have been tested with advantageous results depending upon the particular atomic species provided to generate the desired spectral light output.

With a tin cathode material, 50% less output noise was experienced. With a 15 milliamp tube current, the relative intensity of the 2246 angstrom line increased from 60 to 130, while the 2863 angstrom line increased from 140 to 290.

With a cobalt material, and the tube operating with 20 milliamp current, the relative intensity of the 2407 angstrom line increased from 540 to 700.

With a boron material, a severe arcing problem around the cathode outer diameter was eliminated, and the relative intensity of the 2469 angstrom line at 20 milliamp tube current increased from 44 to 70.

With a selenium material, the warm-up drift time was reduced to less than one third of that of the older design, and the intensity was found to be the same at 10 milliamps as that at 14 milliamps for the previous design.

The currently preferred arrangement for holding the ceramic shield is that shown and described in which a mica disc is used. However, it is within the contemplation of the invention that the shield could be secured by other means such as a retaining ring, spring, cement, and even possibly by extending an arm or sleeve from the anode ring to bear against the shield.

I claim:

1. In a hollow-cathode spectral light source of the type having a hermetically-sealed, generally cylindrical outer envelope, a hollow cathode electrical lead-in extending through a wall of the envelope, anode structure including an anode ring and anode lead-in means, the ring being spaced from the hollowed end of the cathode and supported by the anode lead-in means extending through a wall of the envelope, the improvement comprising:

an interior glass sleeve having an open-ended, diametrically larger part loosely encasing said cylindrical cathode, and a necked down, diametrically smaller part tightly encasing said cathode lead-in so that said cathode is supported in said larger part, the rim of the larger part projecting beyond the face of said hollowed end of the cathode;

a ceramic shield in the general form of a circular disc received in the open end of said sleeve and having at least one part thereof having an outer diameter slightly less than the inside diameter of said larger part of said sleeve, with said one part of said shield being received in the projecting rim part of said sleeve, said shield having a central opening generally aligned with the hollow of said cathode;

holding means fixed to said anode structure and contacting said shield to hold said shield in its position in said sleeve; and the surface of said shield extending in a radial direction between the front face of said central opening and the extreme outer periphery of said shield includes portions at abrupt angles to each other to promote a gap in material depositing on said shield and tending to bridge toward said anode structure.

2. In a hollow-cathode spectral light source of the type having a hermetically-sealed, generally cylindrical outer envelope, a hollow cathode electrical lead-in extending through a wall of the envelope, anode structure including an anode ring and anode lead-in means, the ring being spaced from the hollowed end of the cathode and supported by the anode lead-in means extending through a wall of the envelope, the improvement comprising:

an interior glass sleeve having an open-ended, diametrically larger part loosely encasing said cylindrical cathode, and a necked down, diametrically smaller part tightly encasing said cathode lead-in so that said cathode is supported in said larger part, the rim of the larger part projecting beyond the face of said hollowed end of the cathode;

a ceramic shield in the general form of a circular disc received in the open end of said sleeve and having at least one part thereof having an outer diameter slightly less than the inside diameter of said larger part of said sleeve, with said one part of said shield being received in the projecting rim part of said sleeve, said shield having a central opening generally aligned with the hollow of said cathode;

holding means fixed to said anode structure and contacting said shield to hold said shield in its position in said sleeve; and said holding means comprises a relatively flat, circular insulating disc having a central opening and being disposed generally between said anode and said shield, said insulating disc being fixed to said anode lead-in means and having the portion bordering said central opening of said shield bearing against said shield to maintain said shield in its position in said sleeve.

3. The light source of claim 2 wherein:

said ceramic shield seats upon the end face of the hollowed-end of said cathode.

4. A hollow cathode discharge device comprising:

an outer envelope having a base at one end and a highly transmissive window at another end;

a hollow cathode within said envelope with a bore at one end facing said window and with a first electrical lead-in connected to said cathode and extending through said base of said envelope;

an anode within said envelope spaced from said cathode with a second electrical lead-in connected to said anode and extending through said base of said envelope;

an interior insulating sleeve having a cup-shaped part in which said hollow cathode is disposed with said one end in which said bore is located being recessed from said rim of said cup-shaped part of said interior insulating sleeve;

an insulating shield having an end located within said rim of said sleeve on said hollow cathode and having a central aperture substantially aligned with said bore, said shield fitting closely within said sleeve with freedom to slide therein, whereby said interior insulating sleeve and said insulating shield cooperate to shield external cathode surfaces where electrical discharges are unwanted and to concentrate discharge current for maximum efficiency within said bore.

5. A hollow cathode discharge device in accordance with claim 4, wherein:

an insulating disc closely encircling said shield is affixed to said anode lead-in to thereby support said shield.

6. A hollow cathode discharge device in accordance with claim 4, wherein:

said shield has a first surface disposed facing said cathode with a central portion that is displaced from said one end of said cathode.

7. A hollow cathode discharge device in accordance with claim 4, wherein:

said shield has a second surface facing said anode that is configured with portions at abrupt angles to each other to minimize the build-up of a gettered material in a continuous path on said second surface.

* * * * *